US009856621B2

(12) United States Patent
Johnson, Jr.

(10) Patent No.: US 9,856,621 B2
(45) Date of Patent: Jan. 2, 2018

(54) METHOD OF CONSTRUCTION, INSTALLATION, AND DEPLOYMENT OF AN OFFSHORE WIND TURBINE ON A CONCRETE TENSION LEG PLATFORM

(71) Applicant: Fontain M. Johnson, Jr., Santa Claus, IN (US)

(72) Inventor: Fontain M. Johnson, Jr., Santa Claus, IN (US)

(73) Assignee: DBD Systems, LLC, Lamar, IN (US)

( * ) Notice: Subject to any disclaimer, the term of this patent is extended or adjusted under 35 U.S.C. 154(b) by 0 days.

(21) Appl. No.: 14/121,467

(22) Filed: Sep. 9, 2014

(65) Prior Publication Data

US 2015/0104259 A1 Apr. 16, 2015

Related U.S. Application Data

(63) Continuation-in-part of application No. 13/998,626, filed on Nov. 18, 2013.

(60) Provisional application No. 61/960,069, filed on Sep. 9, 2013.

(51) Int. Cl.

| | |
|---|---|
| ***B63B 21/26*** | (2006.01) |
| ***E02D 27/42*** | (2006.01) |
| ***E02D 27/50*** | (2006.01) |
| ***E02D 27/52*** | (2006.01) |
| ***B63B 21/50*** | (2006.01) |
| *B63B 35/44* | (2006.01) |

(52) U.S. Cl.

CPC ..... *E02D 27/425* (2013.01); *B63B 21/26* (2013.01); *B63B 21/502* (2013.01); *E02D 27/50* (2013.01); *E02D 27/525* (2013.01); *B63B 2021/505* (2013.01); *B63B 2035/446* (2013.01)

(58) Field of Classification Search

USPC ..... 405/223.1, 224, 195.1, 196, 203, 205

See application file for complete search history.

(56) References Cited

U.S. PATENT DOCUMENTS

| | | | |
|---|---|---|---|
| 2,297,043 | A | 9/1942 | Zimmerman |
| 3,404,650 | A | 10/1968 | Miller |
| 3,581,694 | A | 6/1971 | Werenskiold |
| 3,938,342 | A | 2/1976 | Aubert |
| 4,010,560 | A | 3/1977 | Diggs |
| 4,173,935 | A | 11/1979 | Grace |
| 4,573,425 | A | 3/1986 | Pomonik |

(Continued)

*Primary Examiner* — Sean Andrish

(74) *Attorney, Agent, or Firm* — Carrithers Law Office, PLLC

(57) ABSTRACT

Method for construction of a wind turbine generator on a slip formed concrete on a construction/deployment dry dock barge and delivery of WTG and foundation to the installation site as a complete unit. A split hull hydraulic dump scow facilitates the slip form construction and deployment of the slip-formed gravity anchor(s). The barge is sunk as a dry dock to a draft that permits the WTG/WTG foundation to be floated off. The free floating WTG foundation is ballasted with sea water to its operating draft. The tension legs from the gravity anchors are attached to the WTG foundation. The sea water is then removed from the WTG foundation. The gravity anchor(s) is constructed from slip formed concrete on a split hull hydraulic dump scow and deployed to the installation site, with tension legs attached for deployment and attachment to the WTG platform.

10 Claims, 10 Drawing Sheets

(56) References Cited

U.S. PATENT DOCUMENTS

| | | | | |
|---|---|---|---|---|
| 4,821,804 | A * | 4/1989 | Pierce | 166/367 |
| 640,942 | A1 | 6/2002 | Moog | |
| 6,899,049 | B2 | 5/2005 | Gehring | |
| 6,910,831 | B2 | 6/2005 | Raines | |
| 7,059,263 | B1 | 6/2006 | Zimmerman | |
| 7,075,189 | B2 | 7/2006 | Heronemus | |
| 7,234,409 | B2 * | 6/2007 | Hansen | 114/258 |
| 7,422,392 | B2 | 9/2008 | Obermeyer | |
| 7,508,088 | B2 | 3/2009 | Kothnur | |
| 7,566,983 | B1 | 7/2009 | Lyatkher | |
| 7,762,205 | B1 | 7/2010 | Veazey | |
| 7,845,998 | B2 | 12/2010 | Ramachandran | |
| 7,887,261 | B2 | 2/2011 | Stubler | |
| 8,186,966 | B2 | 5/2012 | Numajiri | |
| 8,313,266 | B2 | 11/2012 | Numajiri | |
| 2002/0168233 | A1 | 11/2002 | Bergeron | |
| 2005/0201835 | A1 | 9/2005 | Alliot | |
| 2007/0243063 | A1 | 10/2007 | Schellstede | |
| 2008/0240864 | A1 | 10/2008 | Belinsky | |
| 2009/0129870 | A1 | 5/2009 | Jones | |
| 2009/0191002 | A1 | 7/2009 | Stubler | |
| 2009/0217852 | A1 | 9/2009 | Zaman | |
| 2010/0135728 | A1 * | 6/2010 | Nadarajah | B63B 35/44 405/208 |
| 2010/0135730 | A1 | 6/2010 | Kristensen | |
| 2010/0219645 | A1 | 9/2010 | Yamamoto | |
| 2010/0281819 | A1 * | 11/2010 | Thompson | 52/745.17 |
| 2011/0129304 | A1 | 6/2011 | Wu | |
| 2011/0148115 | A1 | 6/2011 | Roznitsky | |
| 2011/0175365 | A1 | 7/2011 | Hines | |
| 2011/0188945 | A1 | 8/2011 | Hartkopf | |
| 2012/0014752 | A1 | 1/2012 | Caruso | |
| 2012/0112472 | A1 | 5/2012 | Murray | |
| 2012/0148407 | A1 | 6/2012 | Akashi | |
| 2012/0189390 | A1 | 7/2012 | Belinsky | |
| 2012/0299376 | A1 | 11/2012 | Schaefer | |

* cited by examiner

METHOD OF CONSTRUCTION, INSTALLATION, AND DEPLOYMENT OF AN OFFSHORE WIND TURBINE ON A CONCRETE TENSION LEG PLATFORM

RELATED APPLICATIONS

This application is a continuation in part of U.S. application Ser. No. 13/998,626 filed on Nov. 18, 2013 and claims priority from U.S. Provisional application Ser. No. 61/960,069 filed on Sep. 9, 2013 and Provisional Application Ser. No. 61/796,656 filed on Nov. 16, 2012 and Provisional Application 61/797,360 filed on Dec. 6, 2012 all of which are hereby incorporated by reference in their entirety.

FIELD OF INVENTION

A process for installation of a wind turbine generator "WTG" on a tension leg platform/spar using gravity anchors by implementation of a concrete WTG foundation built using the "slip form" method whereby a combination construction/deployment barge allows the WTG and WTG foundation to be delivered to the installation site as a complete unit and stabilized using a gravity anchor comprising a rock filled concrete cylinder made by the slip form method.

BACKGROUND OF INVENTION

Islands such as Hawaii have some of the highest retail electric tariffs, for example (31 cents per kilowatt hour) due to a dependency on diesel generation. Renewable energy is a viable option such as offshore wind, solar and biomass renewable resources.

An offshore wind farm could connect to existing 138 kV grid as an generator. There are limited or no sites for utility scale wind or solar power installations. A direct connection into the 138 KV HECO (Hawaiian Electric Company), system is less costly than an inter island VHDC (Very High Density Cable). An offshore gearless WTG (Wind Turbine Generator) can provide the energy. Concrete slip form technology can be applied utilized with tension leg platforms and gravity anchors.

Conventional platforms are constructed in shallow waters because medium to deep water wind farms to subject to casualties from the elements. Few if any are able to survive the loss of a tension leg. Catenary restrained types or floaters are subject to too much motion such that the well-being of the WTG is compromised. Construction of deep water units are currently dependent upon large construction areas near the wind farm shoreline site which defaces the shoreline. Currently no economical means of building and deploying gravity anchors are available for deep water platforms.

As set forth in U.S. Pat. No. 7,075,189 by Heronemus et al., which is incorporated by reference herein, the term 'wind turbine' encompasses the drive train, gearbox, and generator for embodiments that include these elements. The word 'rotor' refers to the external rotating parts of a wind turbine, namely blades and a hub. Issues regarding loads, materials, structural dynamics, aerodynamics, controls, and power conversion must be taken into consideration in the construction of a wind turbine. The following references provide guidance for wind turbine design, all of which are incorporated herein by reference:

Guidelines for Design of Wind Turbines, Det Norske Veritas, Copenhagen and Riso National Laboratory, Denmark, 2002.

Hau, E., Windturbines—Fundamentals, Technologies, Application, and Economics,
Springer Verlag, Berlin Heidelberg, 2000.

Eggleston, D., Stoddard, F., Wind Turbine Engineering Design, Van Nostrand Reinhold,
New York, 1987.

Burton, T., Sharpe, D., Jenkins, N., Bossanyi, E., Wind Energy Handbook, John Wiley & Sons, West Sussex England, 2001.

Gasch, R., Twele, J., Wind Power Plants—Fundamentals, Design, Construction, and Operation, Solarpraxis AG, Germany, 2002.

Freris, L., Wind Energy Conversion Systems, Prentice Hall International Ltd., London,
1990.

Off shore wind turbines have unique design considerations related to wave loading, dynamics that are different from onshore turbines, corrosion due to a salt-water environment, and other factors. As noted in the above patent special chapters on design of offshore wind turbines can be found in Chapter 13 of the above reference entitled Wind Power Plants—Fundamentals, Design, Construction, and Operation and Chapter 16.6 of the above reference entitled Windturbines—Fundamentals, Technologies, Application, and Economics. The design of wind turbine rotors for a wind ship differs from land-based wind turbines in that the load specification will be different because at the platform tilts backward and forward, the relative wind speed that each rotor encounter varies and this dependence of loads on rotor dynamics is a factor.

SUMMARY OF THE INVENTION

The present invention provides a system which facilitates the construction and installation of a spar buoy foundation for offshore wind turbine generator ("WTG") units. The tension leg platform/spar system includes a WTG foundation, gravity anchors and tension legs which collectively supports a WTG.

The system utilizes a WTG foundation comprising a concrete platform/spar with unique geometry and weight distribution that is specifically designed to be constructed on a barge. The WTG foundation includes a buoyant concrete platform/spar on which the WTG is installed and to which the tension legs are attached to concrete anchors which are weights that rest on or in the sea floor. The anchors in conjunction with the tension legs offset the buoyancy of the WTG foundation and mitigate its motion (restricts heave, roll, pitch, yaw and lateral motion). The anchors can be comprised of concrete, steel, rock, and combinations thereof. The horizontal cross section of the WTG foundation can be any geometrical shape that can be extruded.

The tension leg platform/spar system is stable when free floating with the WTG installed in all circumstances and is anchored to the sea floor by tension legs to secure the unit in place and prevent "heave". The tension Pegs are flexible devices comprising high strength wire rope, steel cable, or the like that connect the WTG foundation to the concrete anchors and transmit the buoyant forces. The platform is permanently moored by means of tethers or tendons grouped at each of the structure's corners. A group of tethers is called a tension leg. A feature of the design of the tethers is that they have relatively high axial stiffness (elasticity) such that virtually all of the vertical motion of the platform is eliminated. It is designed to be stable in 50 foot waves without tension legs becoming slack. It is; partially constructed by economical "slip form" methods. Moreover, the unit is stable even with the loss of one or more tension leg(s), so that it will resist capsizing.

A construction barge assembly comprising a combination barge/dry dock which serves as the constructing platform, transport device and launch mechanism for the WTG foundation. It is designed to be the construction platform on which the spar is constructed and the WTG is installed thereon; transport the spar to the installation site by tugs; be stable in all phases of construction and installation of the spar; perform as a dry dock and be ballasted to a draft that allows the spar to float off; be de-ballasted by self contained pumping system; be built to ABS rules for ocean deck barges with a load line; meet required structural strength for deck loads and longitudinal strength; and be re-used for multiple WTG installations or be converted to heavy duty deck barge.

The scow is a split hull hydraulic dump scow used as a construction and deployment mechanism for the concrete anchors. The concrete anchor is constructed din the hopper of the closed scow. The scow is then used to transport the anchor to the WTG installation site where the scow is opened and the anchor deployed to the sea floor in a controlled manner.

It is an object of the present invention to utilize gravity anchors designed to withstand the maximum design lift forces imparted by tension legs; be constructed of re-enforced concrete or combination of concrete, rock and steel; and be constructed in and deployed form the hopper of a split hull hydraulic scow.

It is an object of the present invention to employ a split hull hydraulic dump scow designed to comply with the ABS rule's for offshore open hopper barges; allow gravity anchors to be constructed in the hopper when in the closed position; to transport the completed gravity anchor to the installation site by tugs, and lower the gravity anchor through an open hopper to position on the sea floor in a controlled manner.

A method for deploying a concrete wind turbine generator tension leg platform includes deployment of a single gravity anchor constructed by using a concrete slip process whereby the gravity anchor is constructed on a barge at a staging dock and transported to a selected site for deployment. The single concrete gravity anchor has at least one air tight compartment and is constructed of slip formed concrete on a construction and deployment barge at a staging dock. The barge is towed to a selected deployment site. An end of a tension leg is attached to the concrete gravity anchor. The construction and deployment barge is sank with water to a selected draft and the concrete gravity anchor is free floated off of the construction and deployment barge. The slip formed concrete gravity anchor is ballasted with water and sinks in a controlled manner to rest on the sea floor. The water is evacuated from the construction and deployment barge which is refloated for re-use.

An alternate method of deploying a gravity anchor involves forming a plurality of concrete gravity anchors. Each one can be formed in a hopper of a split hull hydraulic dump scow and transported to a selected location using GPS to position the gravity anchor. It is deployed by opening the split hull hydraulic dump scow and using a plurality of strand jacks to lower the concrete gravity anchor to rest on the sea floor in a controlled manner. The split hull hydraulic dump scow is closed and reused.

After deployment of the concrete gravity anchor(s), a slip formed concrete wind turbine generator foundation having at least one air tight compartment is slip formed on a construction and deployment barge at a staging dock. A tower can be mounted on the concrete wind turbine generator foundation which may include a nacelle having a generator. The nacelle may support a rotor comprising a hub and plurality of blades connecting thereto. The concrete wind turbine generator foundation is delivered to a selected site above the concrete gravity anchor(s) and sinks by filling the construction and deployment barge with water to a selected draft whereby the concrete wind turbine generator foundation free floats off of the construction and deployment barge to a selected operating draft. The construction and deployment barge is re-floated by evacuating the water therefrom for re-use. A free end of the tension leg extending from the concrete gravity anchor is attached to a selected position on the concrete wind turbine generator foundation. To obtain equal tension on each one of the tension legs extending from the gravity anchor to the concrete wind turbine generator foundation to maintain a selected free board, the water is evacuated from the concrete wind turbine generator foundation with compressed air tightening the plurality of tension legs to a selected equal load.

It is an object of the present invention to provide a method for utilizing a "slip form" method to form a significant portion of the concrete WTG foundation. Slip forming, continuous poured continuously formed, or slip form construction is a construction method in which concrete is poured into a continuously moving form. Slip forming is used for tall structures (such as bridges, towers, buildings, and dams), as well as horizontal structures, such as roadways. Slip forming enables continuous, non-interrupted, cast-in-place "flawless" (i.e. no joints) concrete structures which have superior performance characteristics to piecewise construction using discrete form elements. Slip forming relies on the quick-setting properties of concrete, and requires a balance between quick-setting capacity and workability. Concrete needs to be workable enough to be placed into the form and consolidated (via vibration), yet quick-setting enough to emerge from the form with strength. This strength is needed because the freshly set concrete must not only permit the form to "slip" upwards but also support the freshly poured concrete above it. In vertical slip forming the concrete form may be surrounded by a platform on which workers stand, placing steel reinforcing rods into the concrete and ensuring a smooth pour. Together, the concrete form and working platform are raised by means of hydraulic jacks. Generally, the slip form rises at a rate which permits the concrete to harden by the time it emerges from the bottom of the form.

It is another object of the present invention to devise a method to construct and employ the gravity anchors using the split hull hydraulic dump scow to significantly enhance the economics of using gravity anchors.

It is an object of the present invention to provide a WTG foundation that when installed in the final position has a relatively large water plane to allow for greater stability when free floating. It also allows the economy of deploying the gravity anchors separately of the WTG foundation because the free floating stability of the WTG foundation permits the tension leg to be easily installed in this circumstance. Also the large water plane will keep the WTG stable if tension legs are lost aiding in the prevention of capsizing of the WTG.

It is an object of the present invention to design a floating concrete tension leg platform which can formed by a slip form method on a barge and floated and off loaded from a barge in deep water.

It is an object of the present invention to obtain a 50% reduction in cost in the construction, installation and deployment of a floating concrete tension leg platform as opposed to a conventional steel tension leg platform.

It is an object of the present invention to provide the smallest environmental footprint possible for a tension leg platform for a WTG.

It is an object of the present invention to provide a deep water floating concrete tension leg platform for a WTG which is out of sight of land.

A preferred method for installation of a wind turbine generator "WTG" on a tension leg platform/spar using gravity anchors by implementation of a concrete WTG foundation built using the "slip form" method uses a combination construction/deployment barge allowing the WTG and WTG foundation to be delivered to the installation site as a complete unit and stabilized using a gravity anchor comprising a rock filled concrete cylinder made by the slip form method according to the following steps. Construct the WTG foundation on a construction barge at a dock; form the gravity anchors in the split hull scow and deploy same to the installation site; complete the WTG foundation on the construction barge; install the WTG foundation on the barge before it leaves the dock; tow the construction barge to the installation site using tugs; sink the construction barge to a selected draft such that the WTG foundation with the WTG thereon floats off of the barge (dry dock mode), wherein the WTG foundation with the WTG thereon floats freely and is stable having a positive GM (metacentric height which is a measurement of the initial static stability of a floating body) to, refloat the construction barge with its self-contained pumping system for return to dock; ballasting the WTG foundation with sea water until it reaches its operating draft (approximately five feet of freeboard) maintaining stability throughout the process; positioning the spar over the gravity anchors; attaching the tension legs; and removing the WTG foundation and establishing tension in the tension legs.

The process sets forth a method for installation of a wind turbine generator on a tension leg platform/spar (WTG foundation) which uses gravity anchors built by a slip form method or suction anchors. The process employs a concrete WTG foundation built with the 'slip form' method, a combination construction/deployment barge (barge) which allows the WTG and WTG foundation to be delivered to the installation site as a complete unit and a split hull hydraulic dump scow (scow) which facilitates the construction and deployment of the gravity anchors or perhaps suction anchors. Furthermore, the method of installing a WTG on a tension leg platform/spar on construction/deployment barge includes a tower 47 having a nacelle with a hub and blades extending therefrom. The WTG foundation is constructed in a central portion of the construction/deployment barge having a wing wall at each corner providing a stable platform for free floating the WTG foundation off of the construction/deployment barge. Submerging the construction/deployment barge to a selected deck level maximizes stability during construction of WTG and WTG tower at staging dry dock. Prior to slip forming the WTG foundation, a layer of timber of a selected thickness is positioned beneath the WTG foundation in order to deflect a portion of the load of the WTG foundation due to the difference in rigidity of the concrete WTG foundation and the construction/deployment barge. The slip form method of forming a concrete WTG foundation requires forming a vertical concrete cylinder spar buoy on a combination deck barge dry dock prior to leaving staging dock. Installing a WTG on the concrete foundation is accomplished prior to leaving staging dock. The WTG foundation comprises a lower permanent ballast bottom portion defining a cylinder comprising a heavy concrete with steel reinforcement for lowering the vertical center of gravity. An upper portion comprises a light weight concrete, and an air tight lid comprising light weight concrete seals the upper portion to withstand an internal compressed air pressure of up to 38 psig. The WTG foundation includes a central stem and a plurality of tension leg attachment points at selected positions along vertical conduits disposed within a peripheral wall extending around the periphery of the cylinder. The construction/deployment barge is used to transport the WTG/WTG foundation to deployment site via ocean tug as a complete unit. At the installation site, the barge sinks providing a dry dock at a draft that permits the WTG/WTG foundation to be floated off in a stable condition. The free floating WTG foundation is ballasted with sea water to its operating draft with 5 feet of freeboard. The barge is then raised and returned by tug to the staging dock for another construction cycle. Constructing a plurality of gravity anchors comprising steel reinforced concrete is performed on a split hull hydraulic dump scow having a hopper providing a form for the gravity anchors and attaching a tension leg thereto. Transporting the gravity anchors on the hydraulic dump scow to the installation site is accomplished with an ocean going tug. A selected number of the gravity anchors are deployed opposite one another by opening the split hull hydraulic dump scow and lowering each gravity anchor to the sea floor using multiple strand jacks in a controlled manner using GPS to position each one of the anchors, Each gravity anchor includes a tension leg and each one of the tension legs includes a tag line and buoy attaching to a gravity anchor. The tension legs extending from the gravity anchors are attached to the WTG foundation and snugged with equal tension. The WTG foundation is ballasted with sea water to its operating draft with 5 feet of freeboard. The tension legs from the gravity anchors are attached to the WTG foundation and snugged with equal tension. Removing the sea water ballast from the WTG foundation tightens the tension legs to their design loads is accomplished by applying internal pressure with compressed air for removing the sea water ballast. The process creates a large water plane and a five foot freeboard on the WTG/WTG foundation. The WTG is stable in trough of 50 feet wave without overloading the tension legs and the WTG remains stable even with the loss of a single tension leg.

The concrete WTG foundation is built on a heavy duty combination deck barge/dry dock. The WTG is installed onto the WTG foundation before the barge leaves the staging dock. The barge transports the WTG/WTG foundation to the deployment site via ocean tug(s). The barge is sunk as a dry dock to a draft that permits the WTG/WTG foundation to be floated off in a stable condition. The barge is then raised and returned by tug to the staging dock for another construction cycle. At the installation site, the 'free floating' WTG foundation is ballasted with sea water to its operating draft with 5 feet of freeboard. The tension legs from the gravity anchors are attached to the WTG foundation and snugged with equal tension. The sea water is then removed from the WTG foundation. This process tightens the tension legs to their design loads. The WTG/WTG foundation maintains a relatively large water plane and a 5 foot freeboard. Concurrently with the construction of the WTG foundation, the gravity anchors are constructed and deployed to the installation site, with tension legs attached, by means of a uniquely designed split hull hydraulic dump scow. Four gravity anchors are made and deployed for each WTG installation. The designs of the WTG foundation, the construction/deployment barge, the gravity anchors and the split hull hydraulic dump scow are inextricably related and, collectively facilitate a simple and economic process. The installed WTG foundation will remain floating even in gail force winds and even if one or more of the tension cables breaks due to its self-righting design.

Other objects, features, and advantages of the invention will be apparent with the following detailed description taken in conjunction with the accompanying drawings showing a preferred embodiment of the invention.

BRIEF DESCRIPTION OF THE DRAWINGS

A better understanding of the present invention will be had upon reference to the following description in conjunction with the accompanying drawings in which like numerals refer to like parts throughout the several views and wherein.

DETAILED DESCRIPTION OF THE PREFERRED EMBODIMENT

The slip form concrete WTG foundation is built on a heavy duty combination deck barge/dry dock. The WTG is installed onto the WTG foundation before the barge leaves the staging dock. The barge transports the WTG/WTG foundation to the deployment site via ocean tug(s). The barge is sunk as a dry dock to a draft that permits the WTG/WTG foundation to be floated off in a stable condition. The barge is then raised and returned by tug to the staging dock for another construction cycle. At the installation site, the 'free floating' WTG foundation is ballasted with sea water to its operating draft with 5 feet of freeboard. The tension legs from the gravity anchors are attached to the WTG foundation and snugged with equal tension. The sea water is then removed from the WTG foundation. This process tightens the tension legs to their design loads. The WTG/WTG foundation maintains a relatively large water plane and a 5 foot freeboard.

Prior to the construction of each of the WTG foundations, the concrete parts of the gravity anchors are constructed and deployed to the installation site on a barge, with tension legs attached. Once the concrete cylinders are sunk to the sea floor, they are filled with rock.

Figure 1:
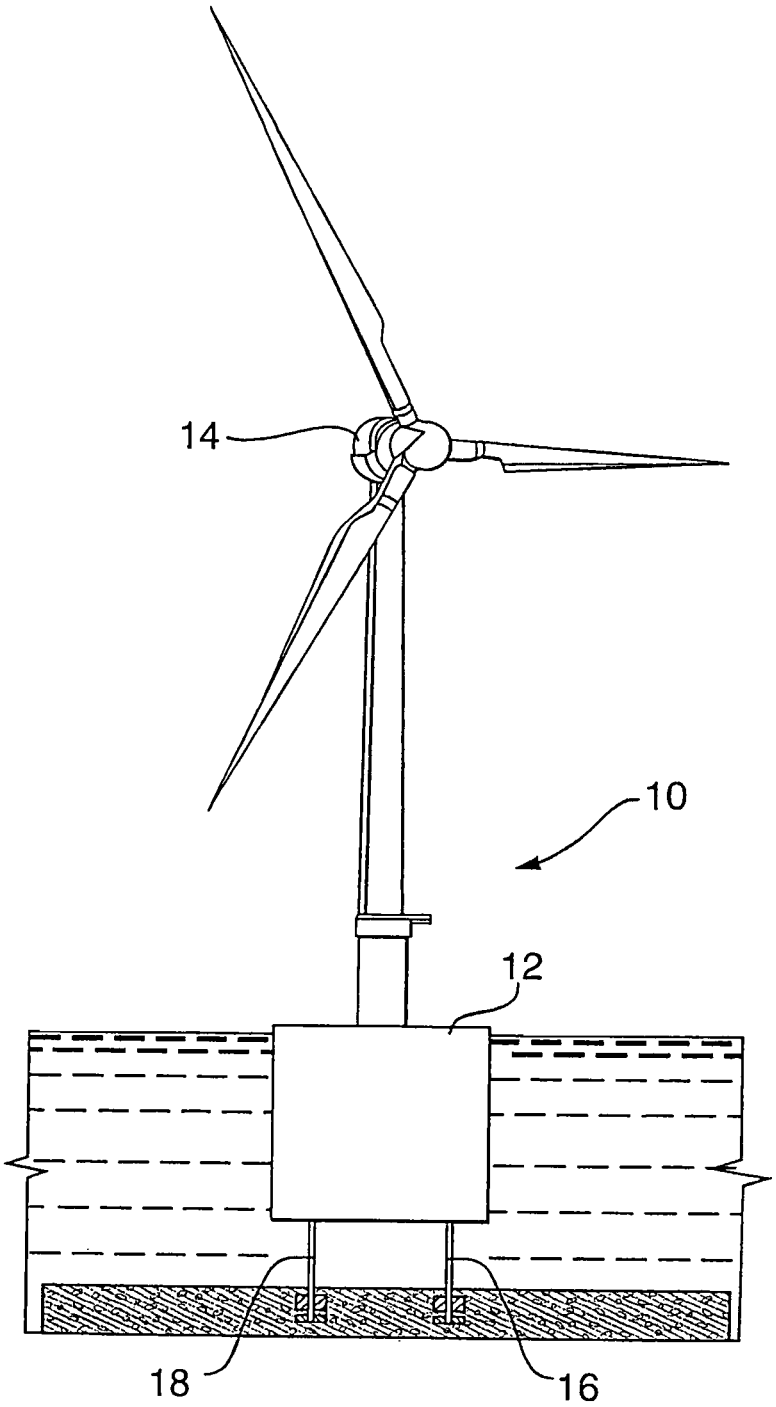
FIG. 1 shows the installed WTG foundation with the WTG, tension legs and gravity anchors.

The designs of the WTG foundation, the construction/deployment barge and the gravity anchors are inextricably related and, collectively facilitate a simple and economic process. FIG. 1 shows the tension leg platform/spar 10 with the installed WTG foundation 12 with the WTG 14, tension legs 16 and gravity anchors 18.

Data for a typical 6 mega watts for a wind turbine generator includes a nacelle weighting approximately 1929 tons, having dimensions of 15100 mm in length, 6500 mm in width, and 7250 mm in height. The tower weights approximately 444 tons and has a top diameter of 4185 mm, and a bottom diameter of 6000 mm, with a height of 87740 mm. The blades weight approximately 33.1 tons, having a length of 75000 mm and height of 5000 mm. The hub weights approximately 104.7 tons and has a width of 7900 mm and height of 5500 mm. It is premised that the hub height is 295 feet and the blades about 43 feet above still water level.

WTG Foundation

The WTG foundation is a vertical concrete cylinder designed uniquely with geometry and weight distribution to: support the 6 MW WTG; be constructed on the barge; be stable when free floated off of the barge; be stable through the entire tension leg attachment process; be stable in trough of 50 ft wave without tension legs becoming slack; be stable in crest of 50 ft wave without overloading tension legs; be stable with loss of a tension leg; and allow internal pressure for compressed air removal of sea water ballast.

Preliminary design of one preferred WTG foundation has been completed to the extent that preliminary costing can be done. The lower portion 22 of the cylinder is heavy concrete with steel re-enforcement. This part of the cylinder is referred to as the permanent ballast and lowers the vertical center of gravity. The upper portion 30 of the cylinder between the permanent ballast and the top or lid 28 is made by the economical 'slip form' method and is made of re-enforced lightweight concrete. The top, or lid, of the cylinder is also made of lightweight concrete. The geometry and thicknesses of the structure is designed to support the WTG to stand up to wind, waves and current and to withstand internal compressed air pressure >36 psi.

The weights, centers of gravity, free floating stability and total tension leg forces must be determined for the following scenario in order to deploy the foundation.

1) WTG/WTG foundation free floating off the barge/dry dock;
2) WTG/WTG foundation free floating; when ballasted down to operating w/o tension legs;
3) WTG/WTG foundation with tension legs attached in calm water;
4) WTG/WTG foundation with tension legs attached in trough of 50 ft wave; and
5) WTG/WTG foundation with tension legs attached in crest of 50 ft wave.

A unique aspect of this WTG foundation is that it has a relatively large water plane in all installation, operating and failure modes. This large water plane contributes significantly to stability. For example, it allows the gravity anchors to be deployed separately from the WTG foundation because its 'free floating' stability facilitates simple tension leg installation. Also, high wind, wave and current loads produce lateral displacement which causes vertical displacement which increases the buoyancy which increases the tension leg loads. This allows lower initial tension leg design loads when considering the possibility of slack tension legs under high loads. A preliminary check of wind, wave and current forces on the WTG/WTG foundation and tension leg system indicates that the larger water plane does not cause unacceptable loads.

Figure 2:
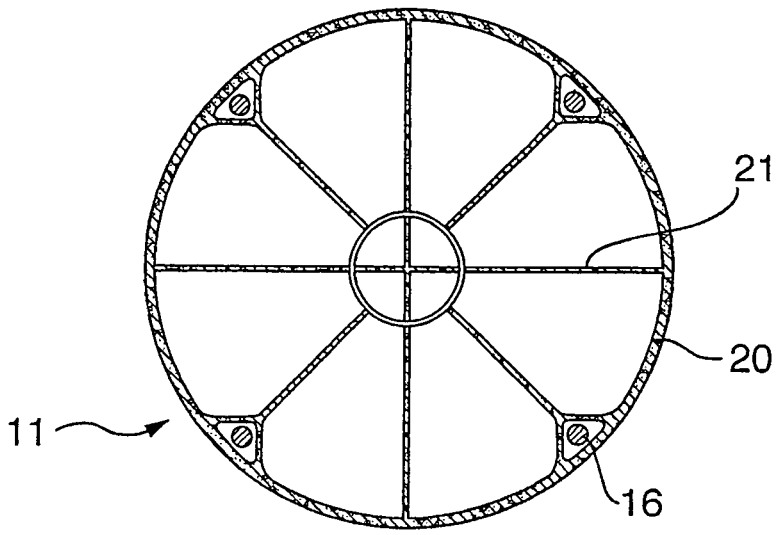
FIG. 2 is a top view showing the concrete cylindrical spar buoy WTG foundation with transition stem.
Figure 3:
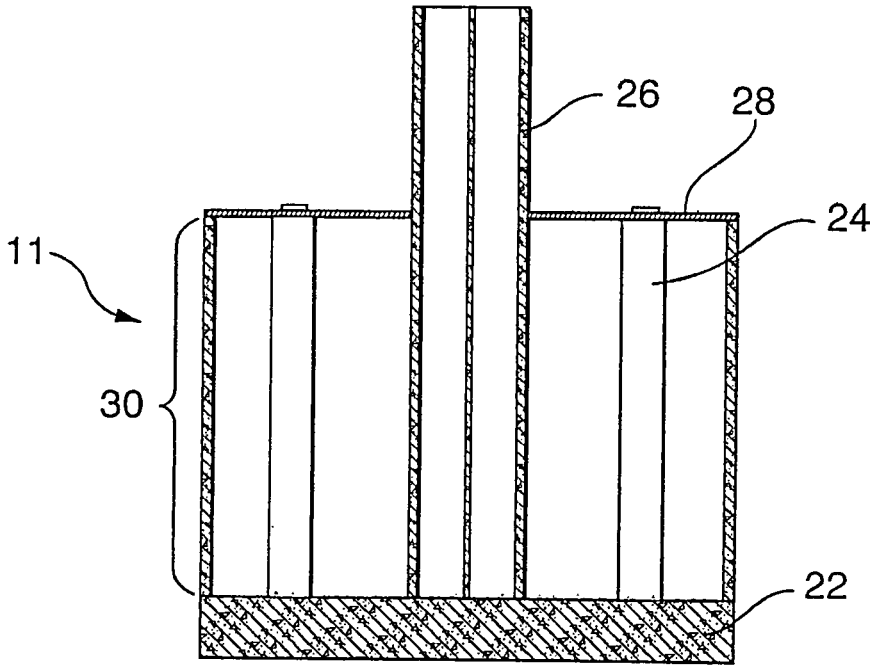
FIG. 3 is a side view showing the concrete cylindrical spar buoy WTG foundation with transition stem.

FIGS. 2 and 3 show the concrete cylindrical spar buoy WTG foundation with transition stem wherein the tension leg 16 is shown as disposed within a triangular support structure formed by junction of the cylindrical slip wall formed cross section 20 and intersecting wall 21. FIG. 3 shows the tension leg pathway 24 formed within the slip formed section 30 supported on a base of heavy concrete ballast 22 with the stem 26 extending vertically therefrom with a lid 28 covering the top of the spar buoy 11.

Construction Barge

The construction barge is a combination deck barge and dry dock. It is specifically designed not to exceed ABS Load Line draft with maximum WTG/WTG foundation load, to withstand local deck loads due to WTG/WTG foundation induced loads, withstand longitudinal bending stresses due to WTG/WTG foundation loads, transport the WTG/WTG foundation to the installation site, withstand pressures due to submergence as a dry dock, have adequate stability with WTG/WTG foundation load in transit mode, have adequate stability during submergence as a dry dock with WTG/WTG foundation have adequate stability when submerged and WTG foundation has floated off, submerge to a draft such that the WTG/WTG foundation can float off, and meet ABS rules for offshore deck barges. Preliminary design of this barge has been completed to the extent that preliminary costing can be done.

Preliminary principle dimensions of the barge for a preferred embodiment include: the total length of wing walls, one side being 270 feet, the overall length of 100 feet, the breadth of 108 feet, the depth at the side being 23.5 feet, the height of the wing walls above the deck being 66 feet, and the width of the wing walls being 34 feet.

Figure 4:
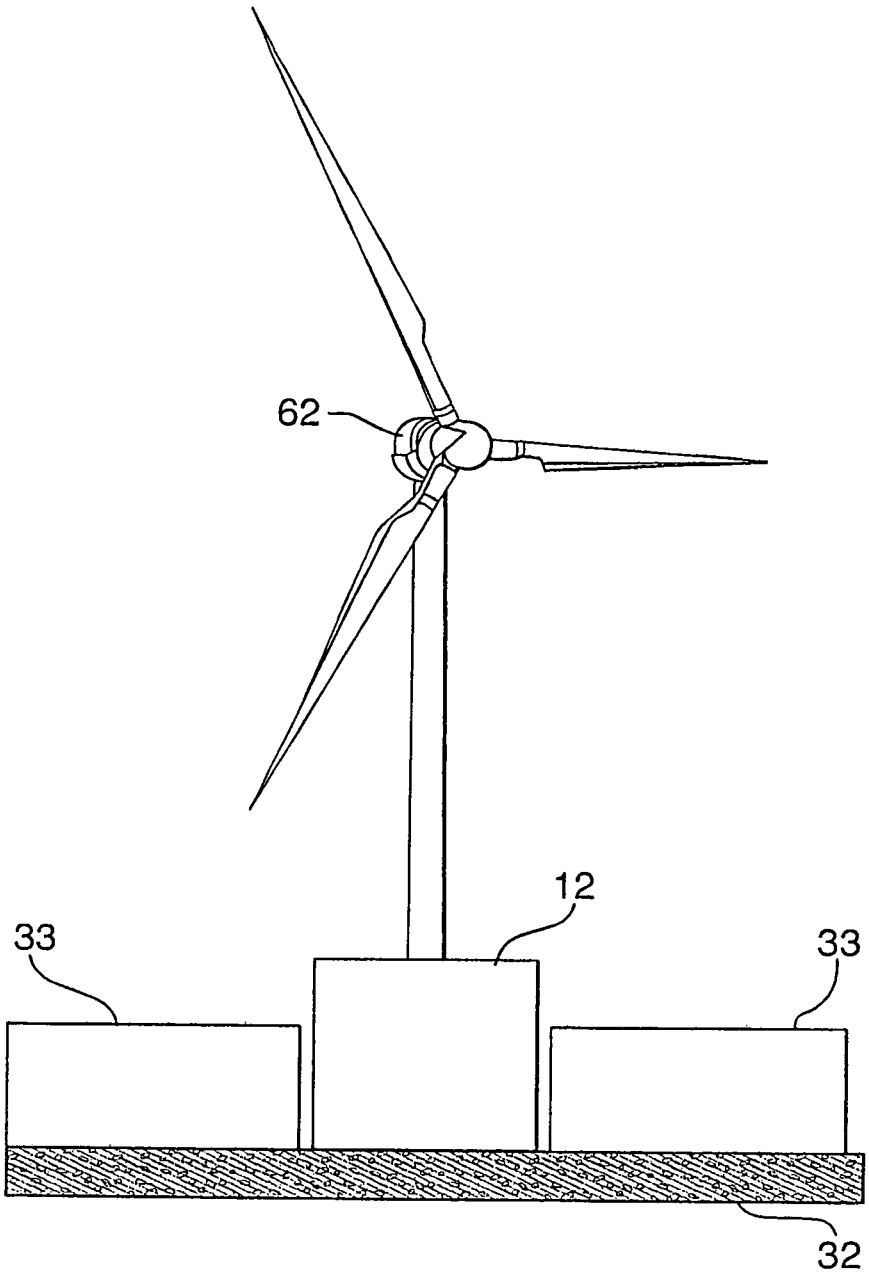
FIG. 4 shows the construction barge supporting the wind turbine WTG, and WTG foundation disposed between wing walls.
Figure 5:
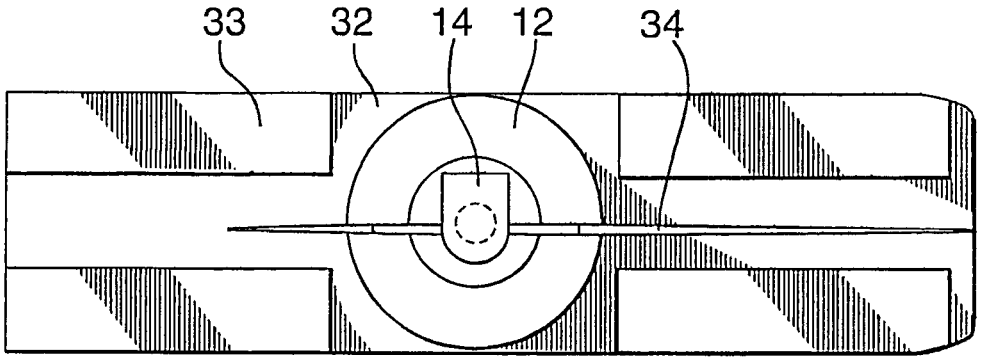
FIG. 5 is a top view of the construction barge showing the wing walls, WTG, and WTG blade positioned upon the barge for transport and deployment.
Figure 6:
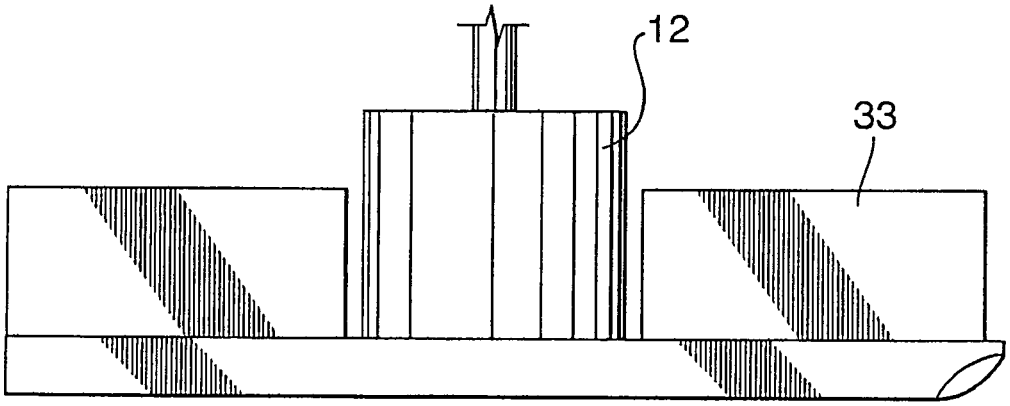
FIG. 6 is an elevational view showing the construction barge supporting the wing walls, WTG, positioned upon the barge for transport and deployment.
Figure 7:
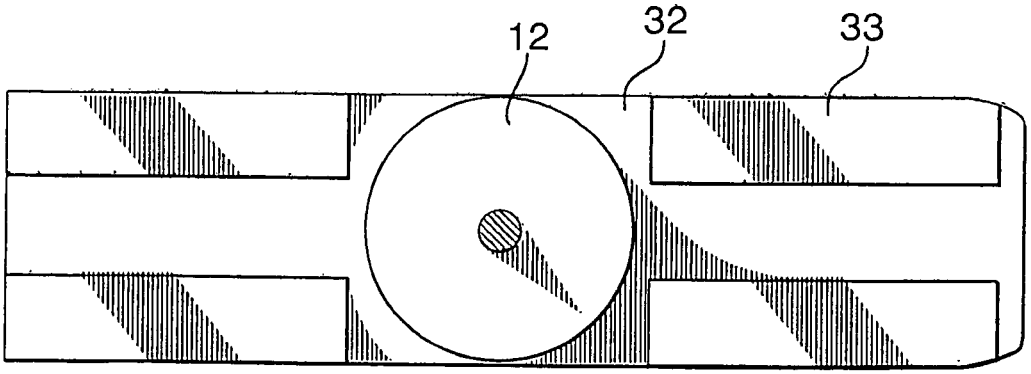
FIG. 7 is an plan view showing the construction barge supporting the wing walls and spar in dry dock.

FIGS. 3-7 depict the construction barge in various views with the WTG/WTG foundation on board. FIG. 4 shows the construction barge 32 supporting the wind turbine WTG 14, WTG spar 12 disposed between wing walls 33. FIG. 5 is a top view of the construction barge 32 showing the wing walls 33, WTG 14, and WTG blades 34 positioned upon the barge for transport and deployment. FIG. 6 is an elevational view showing the construction barge supporting the wing walls, WTG, positioned upon the barge for transport and deployment. FIG. 7 is an plan view showing the construction barge supporting the wing walls and spar in dry dock. The wing walls are air tight hollow steel walls which provide the dry dock/barge with a safety margin. The wing walls provide an area motion of inertia and stability so that the barge can not sink lower than the safety deck during the slip-form construction of the anchor and tension leg platform or spar.

Calculations are required to determine weights, centers of gravity and stability data for the following:
1) Barge in transit mode with completed WTG/WTG foundation unit on board;
2) Barge, as dry dock, submerged to deck level (lowest stability) with WTG/WTG foundation load onboard; and
3) Barge, as dry dock, submerged after WTG/WTG foundation floats off.

The barge and the concrete foundation will not deflect in the same manner due to bending. The barge is less rigid than the concrete foundation. This could cause the barge deck to incur large concentrated loads. To deal with this, a thin layer of selected timber will be placed under the concrete foundation. This timber will be selected to crush and, thus, to distribute the foundation load in an acceptable manner.

Tension Legs

This application will have four (4) pairs of tension legs (8 total tendons) which will connect the WTG/WTG foundation to the gravity anchors. Each tendon will have a design strength of 2000 (short tons) s. tons and (breaking strength of 2500 s. tons. The detail design of tension legs is a proven art and will be provided by others. The load to which the tension legs will be designed is, however, determined by this process. In a preferred embodiment, the total tension load (for all 8 tension legs) for the foundation at operating draft in calm water is 8060 s. tons. This means each leg will endure a calm water load of 1008 s. tons. The maximum tension leg load for a single tendon is estimated as 2016 s. tons and occurs when one pair of tendons (2) are lost (broken). The tension legs will be attached, with tag lines and buoys, to the gravity anchors as the gravity anchors are made.

Installed Stability

There are several aspects of stability to be considered for this process. The "free floating" stability of the WTG/WTG foundation permits float-off from the construction barge and final installation of tension legs. The stability of the construction barge during construction, delivery and off-loading of the WTG/WTG foundation is a factor. The installed stability of the WTG/WTG foundation, complete with tension legs and gravity anchors, must be adequate for the maximum anticipated wind, wave and current loads. There are sophisticated computer programs which offer a probability of what these loads and reactions might be. However, in this preliminary exercise, an approximate manual method is used. The input data is intended to be conservative.

The maximum horizontal wind load at the hub is premised to be 184 s. tons (1643 kn). This comes from multiplying the 124 s. tons (1100 kn) used in the NREL Report, NREL/SR-50046282, for a 5 MG WTG by a ratio of the rotor disc area of the 6 MW WTG to that of the 5 MW WTG. The wave and current forces are, together, estimated at 453 s. tons (in trough of a 50 wave) and act horizontally through the foundation center of buoyancy. This comes from estimating the drag on the underwater part of the cylinder using a combined current and wave mass transfer velocity of 15.3 ft./sec. It is premised in all calculations that the wind, wave and current forces act in the same direction.

Figure 8:
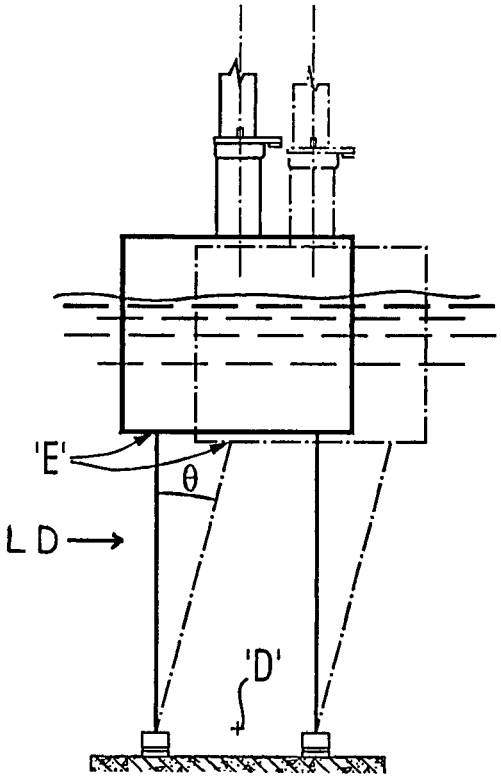
FIG. 8 is a plan view showing the maximum moments about points 'D' (top of anchor) and 'E' (attachment of windward tension leg to foundation)
Figure 9:
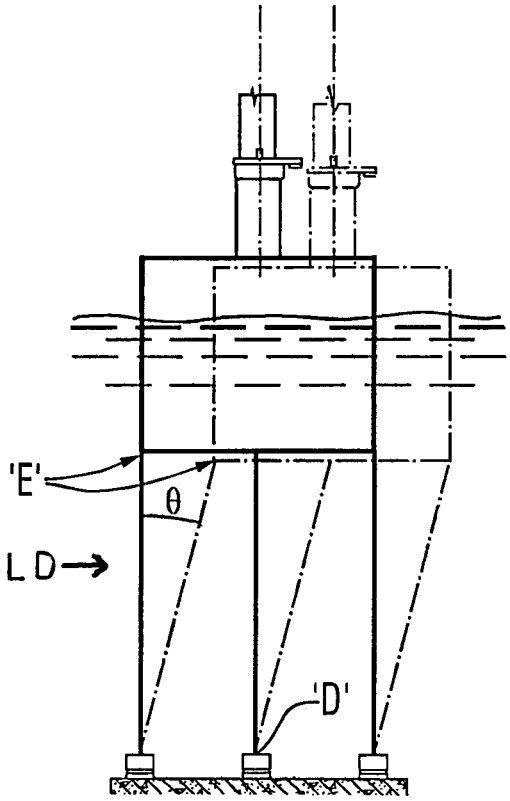
FIG. 9 is a plan view showing lateral displacement resulting from the maximum moments about points 'D' (top of anchor) and 'E' (attachment of windward tension leg to foundation) of FIG. 8.
Figure 10:
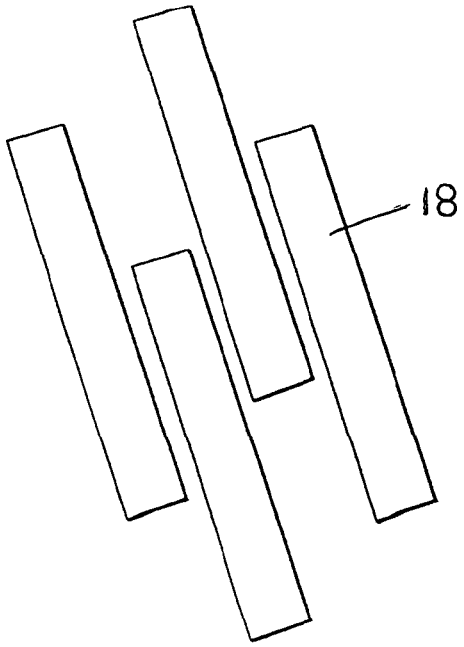
FIG. 10 is a plan showing the dimensions and physical characteristics of the gravity anchor in the 'float-off condition and the 'submerged, fully installed' condition.

This input established the maximum moments about points 'D' (top of anchor) and 'E' (attachment of windward tension leg to foundation). See FIG. 8-9. In response to the moment about 'D', the foundation experiences a lateral displacement (LD), which, simultaneously, causes vertical displacement. This vertical displacement increases the foundation buoyancy and, thus, the tension in the tension legs. In the trough of the 50 ft. wave where buoyancy is lowest, this added tension is significant benefit. In response to the moment about 'E', the tension in the tension legs change to offset this moment. Thus, these loads establish the likely maximum and minimum forces in the tension legs and establish the basis for the design of the gravity anchors.

Requisite calculations are necessary to show the effect of these loads for the following cases:

Case #1—The foundation in the trough of a 50 ft. wave in 300 ft. water with maximum wind, wave and current loads with wind normal to a square tension leg pattern.

Case #2—The foundation in the trough of a 50 ft. wave in 300 ft. water with a maximum wind, wave and current loads with wind normal to a diamond tension leg pattern.

From the above calculations, the maximum and minimum tension leg loads are determined for each case. The minimum forces occur when the foundation is in the trough of the largest wave and the maximum forces occur when the foundation is in the crest of the largest wave. From this, the maximum external loads, with lateral and, thus, vertical displacement, do not slacken a tension leg. In the event of the failure of a pair of tendons, at the operating draft of 88 ft, the WTG/WTG foundation remains upright and stable and can withstand an up-setting moment of 42,243 ft-tons about the point 'E' before the top of the foundation starts to submerge and water plane starts to diminish.

Gravity Anchor

A single gravity anchor, to which the eight tension legs (4 pairs) from the WTG platform are attached, is used for this application. This gravity anchor is a cylindrical concrete container similar to the WTG platform. It will be constructed at the staging dock on the construction/deployment barge, previously described, using the efficient and economical slip forming concrete pouring method.

Figure 11:
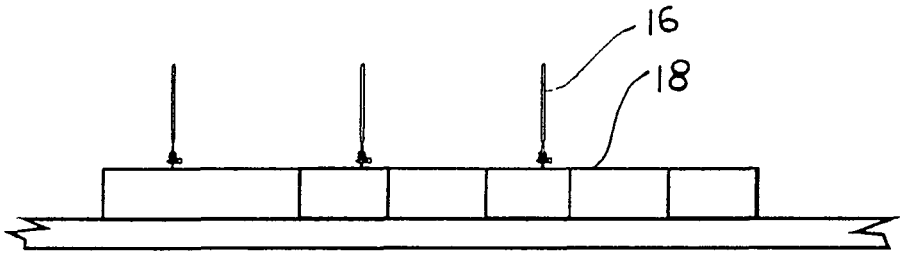
FIG. 11 is a elevational view of the gravity anchor is depicted in FIG. 10.
Figure 12:
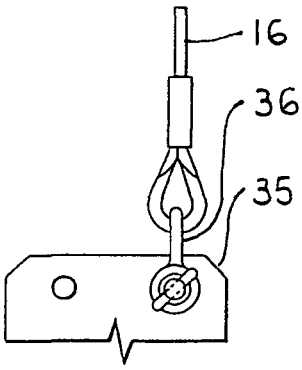
FIG. 12 shows a clevis attached to the anchor block.
Figure 13:
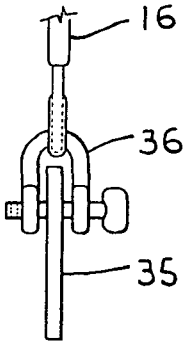
FIG. 13 shows a clevis attached to the anchor block.
Figure 14:
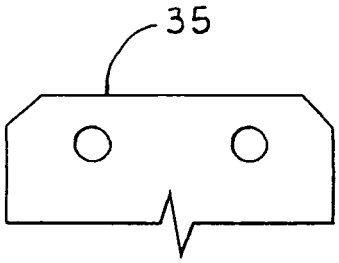
FIG. 14 shows an enlargement of the anchor block of FIG. 12.

It will be deployed to the installation site on the construction/deployment barge and floated off in the same manner that the WTG platform is deployed. After the concrete container part of the gravity anchor is floated off of the deployment barge and positioned, it is sunk by adding sea water. Once on the sea floor, rock is added to achieve the required weight in water of 12,000 s. tons. The gravity anchor is depicted in FIGS. 12-14. In one preferred embodiment four gravity anchors for each WTG foundation or one for each tension leg. Thus, each gravity anchor will be designed to resist a 2908 s. ton load in water. The gravity anchor 18 will be made of heavy re-enforced concrete with steel coupling 35 attaching to a tension leg 16 by an clevis 36 as shown in FIGS. 10-14. Preliminarily, the weight of each gravity anchor that must resist a 2908 s. ton vertical load in water will weigh 4664 s. tons in air. If we premise a density of 170 lb/ft^3, each anchor would have a volume of 54,871 ft^3.

Figure 17:
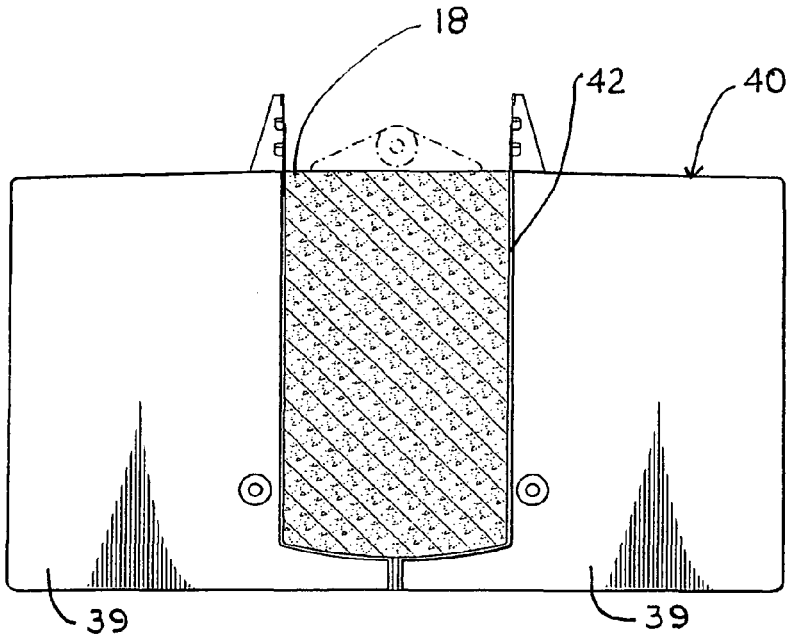
FIG. 17 shows a split hull scow with closed section.
Figure 18:
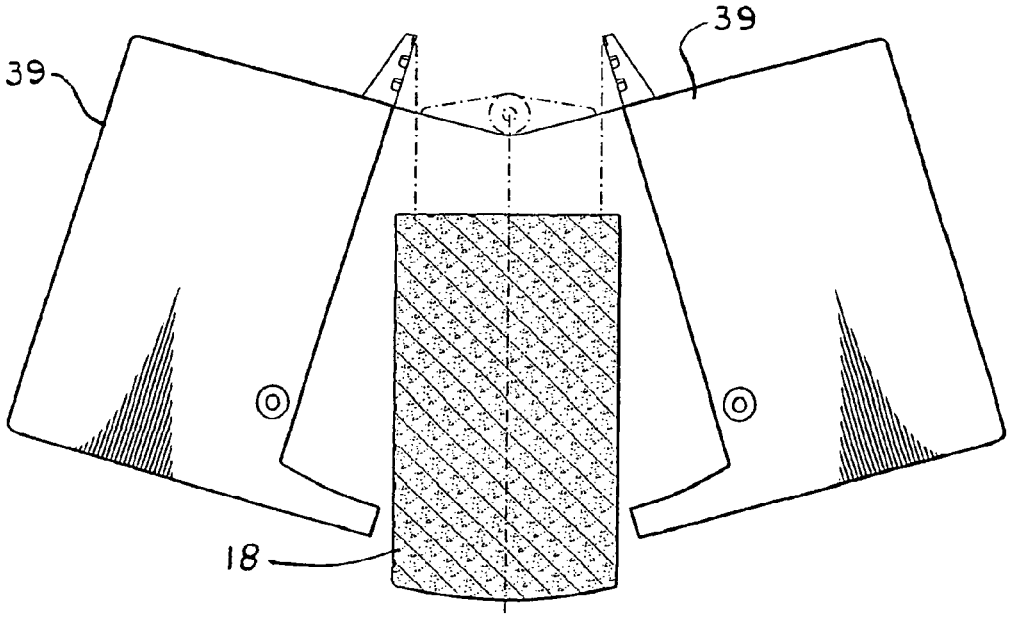
FIG. 18 shows a split bull scow section when open.
Figure 19:
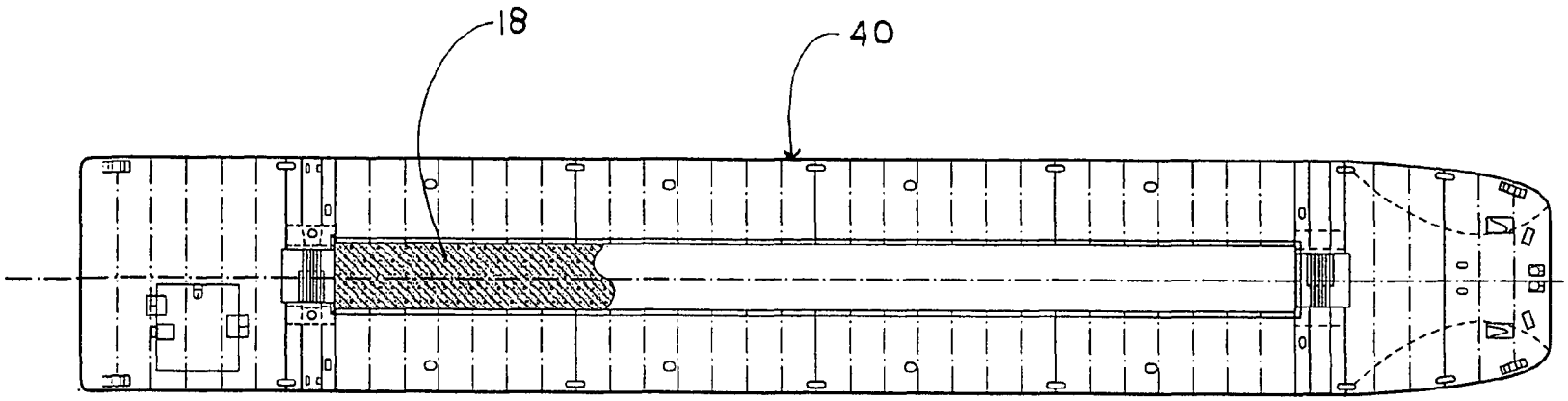
FIG. 19 shows a split hull hydraulic dump scow.
Figure 20:
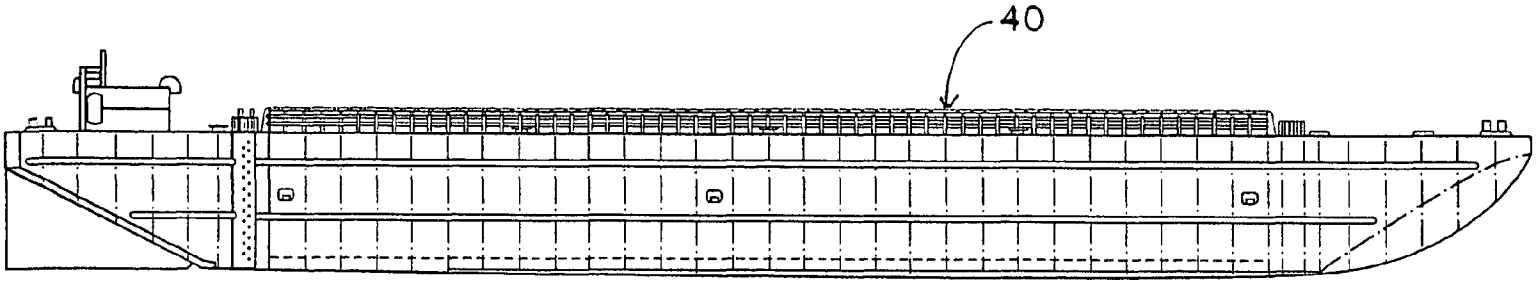
FIG. 20 shows the deck plane and hopper of a split hull hydraulic scow.

As illustrated in FIGS. 17-18, the gravity anchors will be made in the hopper of a split hull 39 hydraulic dump scow 40. The hopper 42 will, in fact, be the form. Based on the size of the scow hopper, the anchor 18 will be 14 ft×22.25 ft×177 ft. Each anchor will also be transported to the installation site and deployed by the scow. FIGS. 10-11 and 15-16 depict a sea floor arrangement for the gravity anchors.

Staging Dock

A staging dock in the vicinity of the wind farm is required. The selected dock will require 800 feet of dock frontage with a minimum of 25 feet of water depth, and a lay down area of about 8 acres.

Split Hull Hydraulic Dump Scow

The scow is unique and specifically designed to produce the concrete gravity anchors required for this application. Its hopper conforms to the dimensions required for the gravity anchor given in the previous section. First, the steel reenforcement will be placed in the scow hopper. The heavy weight concrete will then be poured or pumped into the hopper. Shortly thereafter, the scow will be towed by tug(s) to the installation site. At the site the scow will be opened and the anchor deployed in a controlled manner. GPS will be used to appropriately position each anchor.

Figure 15:
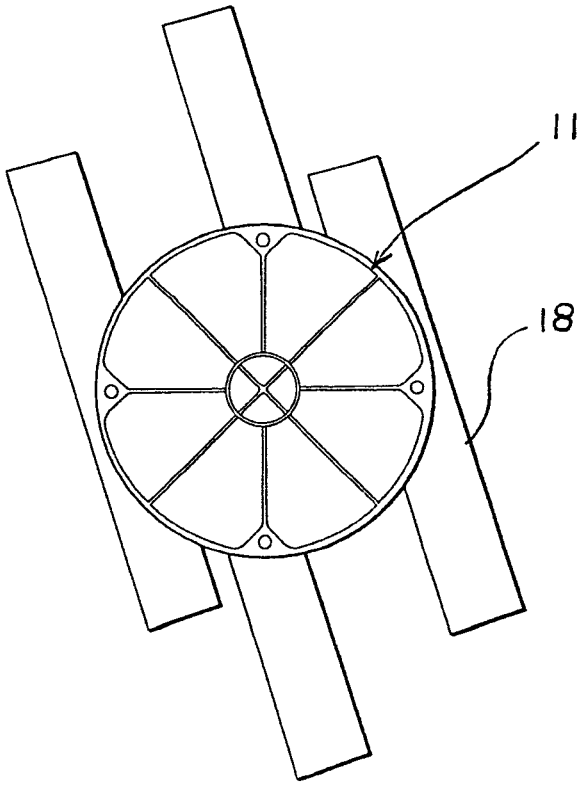
FIG. 15 is a plan showing the dimensions and physical characteristics of the gravity anchor in the 'float-off condition and the 'submerged, fully installed' condition.
Figure 16:
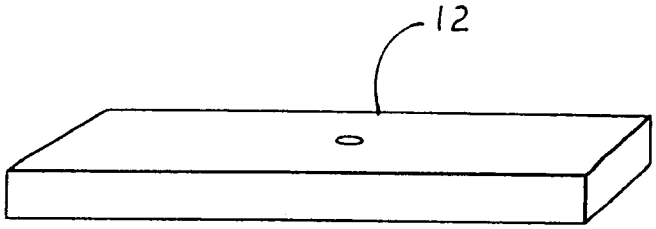
FIG. 16 is a plan showing the dimensions and physical characteristics of the gravity anchor in the 'float-off condition and the 'submerged, fully installed' condition.

Split hull hydraulic dump scows have been used in the dredging industries for many years to transport dredging spoils to specified disposal sites. Dump scow technology has, thus far, not been applied to produce and/or deploy gravity anchors (or any other type of concrete items). Preliminary design of this scow has been completed to the extent that preliminary costing can be done and is shown in FIGS. 15, 11, and 12.

An added feature for the scow in this application is the use of multiple strand jacks to lower the anchor to the sea floor in a controlled manner. This application will use approximately twenty-four (24) 220 s. ton jacks, twelve (12) spaced on each side of the hopper at the hopper coaming. The jacks can be synchronized to lower the anchor in a controlled manner.

An added feature for the scow in this application is the use of multiple strand jacks to lower the anchor to the sea floor in a controlled manner. This application will use approximately twenty-four (24) 220 s. ton jacks, with (12) spaced on each side of the hopper at the hopper coaming. The jacks can be synchronized to lower the anchor in a controlled manner.

The scow has preliminary principal dimensions as follows:

Length overall 0.240
Breadth 0.46 ft
Depth @ side 25.5 ft.
Hopper volume −55136 ftA3

In an alternate embodiment, the slip form concrete WTG foundation is built on a heavy duty combination deck barge/dry dock along shore so that dock cranes and equipment is readily available to make the slip form concrete platform fabrication very economical as compared to conventional platforms of steel or concrete requiring a crane barge to be located on site in deep water to deploy the platform, gravity anchors and WTG.

Figure 21:
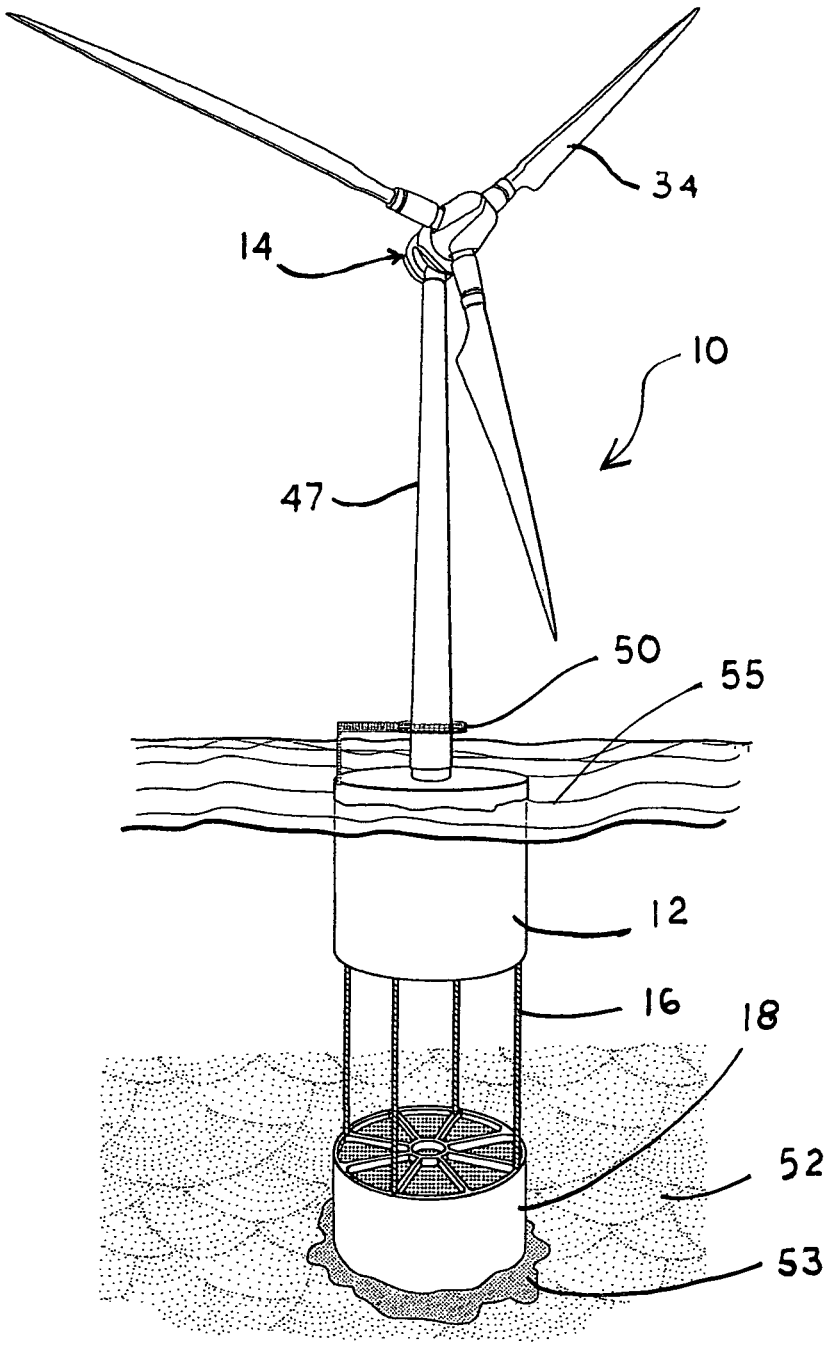
FIG. 21 shows the deployment of an offshore wind turbine on a floating concrete tension leg platform and a WTG and platform loaded onto a barge pulled by an ocean tug to the deployment site.

The WTG is installed onto the WTG foundation before the barge leaves the staging dock. Currently there are no cranes available large enough to lift the blades onto the WTG therefor they are fitted to the WTG unit prior to leaving the dry dock. The barge transports the WTG and WTG platform to the deployment site via ocean tug(s) as shown in FIG. 21. A separate heavy duty combination deck barge and dry dock is used to slip from the gravity anchor which comprises a cylindrical member including several sections as shown in FIG. 2 with integral conduits formed therein in the slip forming process at selected locations around the interior periphery at the junction of the sections walls which intersects a central column. The barge is sunk as a dry dock to a draft that permits the WTG platform anchor(s) to be floated off in a stable condition.

Four slabs with individual tendons may be used to connect the platform to the anchor, or a single cylindrical slip-formed anchor can be poured sized and shaped in accordance with the dimensions of the WTG platform as shown in FIG. 21. Preferably the tendons are comprised of synthetic material which are impervious to corrosion as compared to conventional steel cables of anchor chains. The tendons are pre-attached to the slip-formed anchor and include ID tags attached to buoys which float on the surface for mating to the WTG platform or spar. Prior to the construction of each of the WTG foundations, the concrete part of the gravity anchors are constructed and deployed to the installation site on a barge, with tension legs attached. Once the concrete cylinders are sunk to the sea floor, they may be filled with rock or concrete or other filler.

FIG. 21 also shows the WTG 14 having a plurality of blades 34 supported by the tower 47 extending from the WTG foundation or spar 12 held by tension lines 16 leading to a gravity anchor 18 resting on the sea bed 53. The top of the spar 12 protrudes slightly above the surface 55 of the water 52. A catwalk extends from the top of the spar 12 above the water to a point on the tower 47.

The barge is sunk as a dry dock to a draft that permits the WTG/WTG foundation to be floated off in a stable condition. The WTG foundation platform is slip-formed and the cap is also slip-formed to provide an air-tight seal so that a given volume of air trapped inside of the WTG foundation platform enables the deployment thereof at a controlled descent. For instance, The slip-formed platform having a WTG mounted thereon includes a bottom portion or base comprising ten feet of solid concrete. The cylindrical slip-formed body comprises sixty feet of concrete poured on top of the base. A slip-formed cap comprises a solid concrete slab of from 1 to 1½ feet of solid concrete. Optionally a steel adapter or transition sized and shaped to be disposed between the cap and WTG support beam or shaft may be attached to the center of the cap and/or central portion of the slip-formed concrete WTG platform to facilitate maintenance or replacement of the WTG thereon. Temporary conduits or pipes extend from the top of the platform above the water level to facilitate threading of the tension lines from the anchor to be disposed there through.

Deployment of the WTG spar involves sinking the barge to a predetermined level and off loading the WTG platform. At the installation site, the 'free floating' WTG foundation is ballasted with sea water to sink 35 to 40 feet until the pipes or conduits extending from the cap and containing the tendons are above its operating draft with 2-5 feet of freeboard. Valves are opened to allow a sufficient amount of water to enter the water tight platform body to sink the WTG platform to the desired level and the pipes or conduits extending from the cap are floated off to be reused. The barge is then raised and returned by tug to the staging dock for another construction cycle.

The tension legs from the gravity anchors are attached to the WTG foundation and snugged with equal tension to pull the WTG platform down to a desired depth. The amount of tension required is dependent upon the amount of air allowed to remain in the WTG platform body and the tendons are tightened to the desired tension. For instance, about 200 tons of pressure is required on each tendon when the WTG platform is suspended at the water level, wherein about 300 tons of pressure is exerted on each tendon when the WTG platform is sink to the desired level below water. The sea water is then removed from the WTG foundation. This process tightens the tension legs to their design loads. The WTG/WTG foundation maintains a relatively large water plane and a 5 foot freeboard.

The foregoing detailed description is given primarily for clearness of understanding and no unnecessary limitations are to be understood therefrom, for modification will become obvious to those skilled in the art upon reading this disclosure and may be made upon departing from the spirit of the invention and scope of the appended claims. Accordingly, this invention is not intended to be limited by the specific exemplifications presented herein above. Rather, what is intended to be covered is within the spirit and scope of the appended claims.

I claim:

1. A method of constructing and deploying a wind turbine generator (WTG) unit and gravity anchor in open water, comprising the steps of:

positioning a construction and deployment barge adjacent a staging dock;

positioning a slip form in a central portion of said construction and deployment barge, said construction and deployment barge having a wing wall at each corner;

positioning a layer of timber of a selected thickness beneath a WTG foundation prior to slip forming same and deflecting the load of said WTG foundation due to a difference in rigidity of said WTG foundation and said construction and deployment barge;

slip forming said concrete WTG foundation on said construction and deployment barge prior to leaving said staging dock;

mounting a tower on said WTG foundation;

mounting a WTG on said tower, said WTG including a nacelle with a hub and a plurality of blades extending therefrom defining the WTG unit;

transporting said WTG unit to a deployment site with a first tug or with a second tug;

pumping a selected amount of sea water into said wing walls thereby partially sinking said construction and deployment barge to a selected draft permitting said WTG unit to be floated off of said construction and deployment barge in a stable free floating condition;

positioning said free floating WTG unit off of said construction and deployment barge;

pumping sea water into said WTG foundation ballasting same with said sea water to a selected operating draft;

attaching a tension leg from at least one gravity anchor to said WTG foundation;

tightening said tension leg from said at least one gravity anchors with equal tension by pumping said sea water from said WTG foundation; and tightening said tension leg to a selected design load by applying compressed air to said WTG foundation thereby removing a selected amount of said sea water.

2. The method of constructing and deploying a WTG unit and gravity anchor of claim 1, including the step of attaching said tension leg to said at least one gravity anchor prior to deploying said at least one gravity anchor.

3. The method of constructing and deploying a WTG unit and gravity anchor of claim 1, including the step of using a global positioning system, GPS to position said at least one gravity anchor.

4. The method of constructing and deploying a WTG unit and gravity anchor of claim 1, including the step of using a global positioning system, GPS, to position said construction and deployment barge containing said WTG unit at a selected position with respect to said at least one gravity anchor.

5. The method of constructing and deploying a WTG unit of claim 1, including the step of constructing and deploying said at least one gravity anchor comprising the steps of:

positioning a split hull hydraulic dump scow adjacent a staging dock;

positioning a slip form in said hydraulic dump scow;

slip forming said at least one concrete gravity anchor in said hydraulic dump scow prior to leaving said staging dock;

transporting said at least one gravity anchor on said hydraulic dump scow to said installation site by said first tug or a second tug; and deploying said at least one gravity anchor in a selected location by opening said split hull hydraulic dump scow and lowering said at least one gravity anchor to a sea floor.

6. The method of constructing and deploying a WTG unit of claim 5, including the step of attaching said tension leg to said at least one gravity anchor prior to deploying said at least one gravity anchor.

7. The method of constructing and deploying a WTG unit of claim 5, including the step of using multiple strand jacks to deploy said at least one gravity anchor on said sea floor in a controlled manner.

8. The method of constructing and deploying a WTG unit of claim 1, including the step of slip forming a lower permanent ballast bottom portion of said WTG foundation with concrete forming a solid base for lowering the vertical center of gravity, slip forming an upper portion including at least one hollow compartment therein, said upper portion cooperatively engaging an air tight lid sealing said upper portion.

9. The method of constructing and deploying a WTG unit of claim 1, including the step of slip forming a central column and a plurality of tension leg attachment points at selected positions around a peripheral wall of an upper body portion.

10. The method of constructing and deploying a WTG unit of claim 5 including the step of slip forming a plurality of gravity anchors from concrete in said split hull hydraulic dump scow.

* * * * *